US008896496B2

(12) United States Patent
Kittinger et al.

(10) Patent No.: US 8,896,496 B2
(45) Date of Patent: Nov. 25, 2014

(54) CONFIGURABLE ANTENNA ELEMENT

(75) Inventors: Gregg R. Kittinger, Pontiac, MI (US); Donald B. Hibbard, Jr., Howell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 361 days.

(21) Appl. No.: 13/281,595

(22) Filed: Oct. 26, 2011

(65) Prior Publication Data

US 2013/0106658 A1 May 2, 2013

(51) Int. Cl.
*H01Q 1/40* (2006.01)
*H01Q 1/32* (2006.01)

(52) U.S. Cl.
CPC ... *H01Q 1/32* (2013.01); *H01Q 1/40* (2013.01)
USPC ..... 343/873; 343/711

(58) Field of Classification Search
USPC ..... 343/711, 713, 873
See application file for complete search history.

(56) References Cited

U.S. PATENT DOCUMENTS 4,184,000 A 1/1980 Denman
6,166,698 A * 12/2000 Turnbull et al. ..... 343/713
6,276,607 B1 * 8/2001 Sato ..... 235/487
6,937,153 B2 * 8/2005 Redlin ..... 340/572.8
2004/0080459 A1 4/2004 Marx

FOREIGN PATENT DOCUMENTS

| | | | |
|---|---|---|---|
| CN | 2889797 | Y | 4/2007 |
| CN | 201511906 | U | 6/2010 |
| DE | 4008899 | C1 | 4/1991 |
| DE | 10060603 | A1 | 6/2002 |
| DE | 10040872 | B4 | 2/2005 |
| DE | 102004063266 | A1 | 8/2005 |
| WO | 9221161 | A1 | 11/1992 |
| WO | 0142051 | A1 | 6/2001 |

OTHER PUBLICATIONS

3M Automotive; Buzz, Squeak & Rattle Solutions; http://solutions.3m.com/3MContent RetrievalAPI/BlobServlet?; Aug. 16, 2005; 4 pages.
German Office Action for Application No. 10 2012 219 186.0 dated Aug. 1, 2013; 5 pages.
Chinese Office Action for CN Application No. 201210416295.1 dated May 28, 2014: 9 pages.

* cited by examiner

*Primary Examiner* — Tan Ho
(74) *Attorney, Agent, or Firm* — Cantor Colburn LLP

(57) ABSTRACT

A configurable antenna element comprises a conductor encased in a foam substrate with a pressure sensitive adhesive applied to a surface of the foam substrate for application of the configurable antenna to a surface.

12 Claims, 1 Drawing Sheet

CONFIGURABLE ANTENNA ELEMENT

FIELD OF THE INVENTION

Exemplary embodiments of the invention are related to antennas for applications in mobile and other applications.

BACKGROUND

The electronic age, and miniaturization of electronics, has provided the ability for mass connectivity as exemplified by the desire for mass connectivity in virtually every aspect of human life. Connectivity during transport, such as in a vehicle, is highly desirable considering the extended periods of time the average individual now spends commuting to work as well as to other activities. Multiple devices are now available in vehicles that allow individuals to "connect" with the outside world while operating a motor vehicle. Such devices include such traditional staples such as the radio but also include more complex navigational systems and other information systems. Most, if not all of these systems rely upon connections to external networks for transmission and receipt of information and, as such, require some form of antenna for connection thereto.

Traditionally motor vehicle antennas have been attached to the vehicle body (fender, roof, and window) where they have been prone to breakage, vandalism, and corrosion due to the perforation of the panel. In addition, from an aesthetics standpoint, a vehicle bristling with antennae is less than desirable and may detract from the vehicle's overall fuel efficiency by increasing the drag coefficient. One solution has been to develop hidden antenna elements such as stamped aluminum sheets or wires which are disposed in non-conductive vehicle panels such as rear spoilers or other polymer panels. Due to the dimensional complexity of these panels the stamped metal or wire assemblies typically require complex dies and cutouts for fitments such that assembly by the supplier is cost prohibitive. In addition, performance is often compromised.

SUMMARY OF THE INVENTION

In an exemplary embodiment, a configurable antenna element comprises a conductor encased in a foam substrate and a pressure sensitive adhesive applied to a surface of the foam substrate for application of the configurable antenna to a surface.

The above features and advantages, and other features and advantages of the invention are readily apparent from the following detailed description of the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

Figure 1:
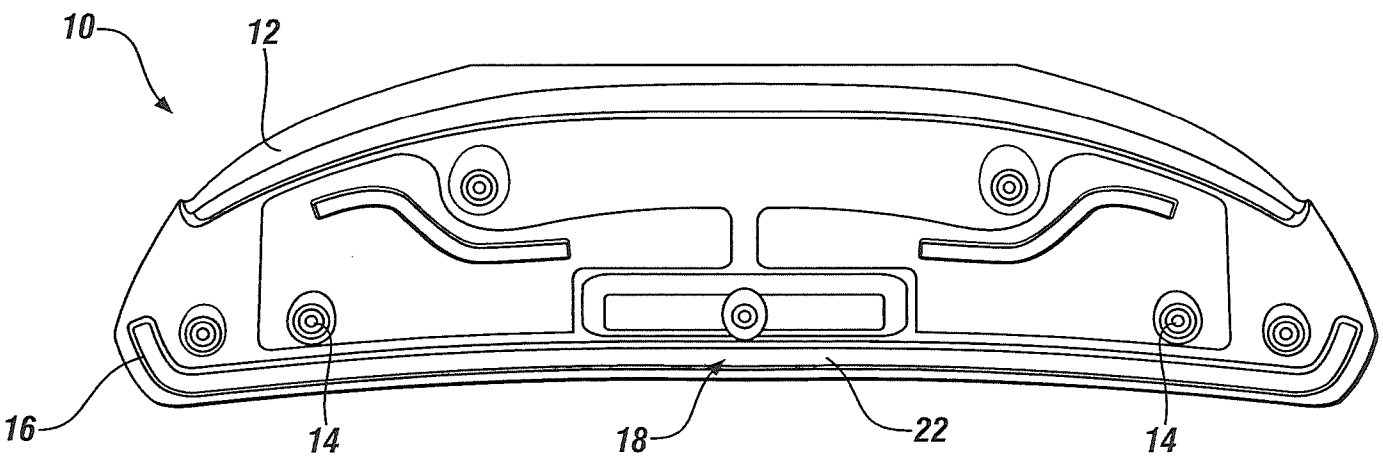
FIG. 1 is an underbody view of a vehicle body panel embodying features of the invention.

The following description is merely exemplary in nature and is not intended to limit the present disclosure, its application or uses. It should be understood that throughout the drawings, corresponding reference numerals indicate like or corresponding parts and features.

Figure 2:
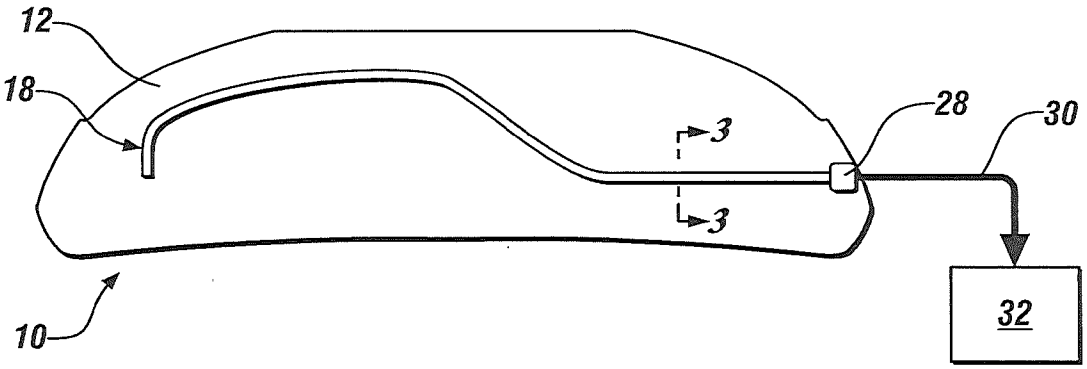
FIG. 2 is a schematic view of the vehicle body panel of FIG. 1 illustrating additional features and embodiments of the invention.

Referring to FIGS. 1 and 2, in an exemplary embodiment, a vehicle body panel 10 is illustrated. It should be noted that the panel illustrated may be any nonconductive body panel of the vehicle and may also apply to other non-vehicular applications as well. The vehicular body panel includes an interior or underbody surface 12 which is typically not visible when the vehicle is assembled and may include various attachment points 14 for attachment of the vehicle body panel to the vehicle (not shown). Additionally, other features such as molded guides or channels 16 may also be integrally located in the underbody surface 12 for the addition of features to be described.

Figure 3:
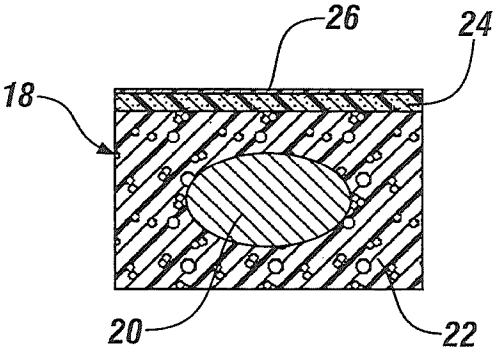
FIG. 3 is a schematic, cross sectional view taken at line 3-3 of FIG. 2.

Referring to FIG. 3, with continued reference to FIGS. 1 and 2, a configurable antenna element 18 is disposed within the vehicle body panel 10 and includes a conductor 20 which is constructed of a standard metal/wire antenna element that is encased in a foam substrate 22. The foam substrate 22 is of the type of material that is commonly referred to in the industry as a Buzz, Squeak and Rattle ("BSR") material which is used to dampen noise is a vehicle in order to make the driving experience more enjoyable. Such materials may include cellular foam, EPDM and other suitable materials. Applied to a surface of the foam substrate 22 is a Pressure Sensitive Adhesive ("PSA") 24 with a removable liner 26. The liner 26 protects the PSA 24 until the configurable antenna element is ready for installation into the vehicle body panel 10.

Referring to FIG. 1, installation of the configurable antenna element 18 into the underbody surface 12 of the vehicle body panel 10 simply involves the removal of the removable liner 26 from the PSA 24 and placement of the foam substrate 22 including the conductor 20 in a pre-defined space which may FIG. 1, or may not FIG. 2, comprise molded guides or channels 16. An end portion of the configurable antenna element 18 may be stripped of the foam substrate 22 following installation and utilized as a transition 28 to Coax cable 30 for attachment to an audio amplifier 32.

The ease of installation of the configurable antenna element 18 reduces the cost of assembly of the vehicle body panel 10 and increases the reliability of the antenna reception. In addition, the configurable antenna element 18 may be shipped to the supplier of the vehicle body panel in bulk (i.e. a roll) which may be cut during assembly or it may be pre-cut and shipped thereby adding flexibility to the manufacturing process as well as allowing various features to be added to the antenna, if required, prior to assembly to the vehicle body panel 10.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the present application.

What is claimed is:

1. A configurable antenna element comprising:

a conductor having an encased portion that is encased in a foam substrate; and a pressure sensitive adhesive applied to a surface of the foam substrate for application of the configurable antenna to a surface;

the conductor having an end portion that extends from the foam substrate for attachment to an electrical device.

2. The configurable antenna of claim 1, wherein the conductor is constructed of a standard metal/wire antenna element.

3. The configurable antenna of claim 1, wherein the foam substrate is of the type of material that is a Buzz, Squeak and Rattle ("BSR") material which is used to dampen noise is a vehicle.

4. The configurable antenna of claim 3, wherein the BSR material includes cellular foam or EPDM.

5. The configurable antenna of claim 1, wherein a removable liner is applied to and protects the pressure sensitive adhesive until the configurable antenna element is ready for installation.

6. A vehicle body panel having a configurable antenna disposed therein comprising:

a conductor having an encased portion that is encased in a foam substrate; and a pressure sensitive adhesive applied to a surface of the foam substrate for application of the configurable antenna to the vehicle body panel;

the conductor having an end portion that extends from the foam substrate for attachment to an electrical device.

7. The vehicle body panel of claim 6, wherein the conductor is constructed of a standard metal/wire antenna element.

8. The vehicle body panel of claim 6, wherein the foam substrate is of the type of material that is a Buzz, Squeak and Rattle ("BSR") material which is used to dampen noise is a vehicle.

9. The vehicle body panel of claim 8, wherein the BSR material includes cellular foam or EPDM.

10. The vehicle body panel of claim 6, wherein a removable liner is applied to and protects the pressure sensitive adhesive until the configurable antenna element is ready for installation.

11. The vehicle body panel of claim 6, wherein molded guides or channels are integrally located in an underbody surface thereof for application of the configurable antenna thereto.

12. The vehicle body panel of claim 6, wherein the end portion of the conductor is utilized as a transition to a Coax cable or a connector for attachment to an audio amplifier.

* * * * *